US009411272B2

(12) United States Patent
Matsubara et al.

(10) Patent No.: US 9,411,272 B2
(45) Date of Patent: Aug. 9, 2016

(54) HEATING DEVICE, FIXING DEVICE, AND IMAGE FORMING APPARATUS

(71) Applicant: FUJI XEROX CO., LTD., Tokyo (JP)

(72) Inventors: Takashi Matsubara, Kanagawa (JP); Tetsuro Kodera, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/613,478

(22) Filed: Feb. 4, 2015

(65) Prior Publication Data

US 2016/0026122 A1 Jan. 28, 2016

(30) Foreign Application Priority Data

Jul. 25, 2014 (JP) ..... 2014-152311

(51) Int. Cl.
*G03G 15/20* (2006.01)

(52) U.S. Cl.
CPC ..... *G03G 15/2007* (2013.01); *G03G 15/2053* (2013.01); *G03G 2215/2035* (2013.01)

(58) Field of Classification Search
CPC ..... G03G 15/2007; G03G 15/2064; G03G 12/2053; G03G 2215/20
See application file for complete search history.

(56) References Cited

U.S. PATENT DOCUMENTS 4,121,888 A 10/1978 Tomura et al.
4,435,069 A * 3/1984 Sato ..... G03G 15/2053 219/216
2011/0044740 A1 2/2011 Matsubara et al.

FOREIGN PATENT DOCUMENTS

JP 53-3241 A 1/1978
JP 2011-043609 A 3/2011

* cited by examiner

*Primary Examiner* — Erika J Villaluna
(74) *Attorney, Agent, or Firm* — Sughrue Mion, PLLC

(57) ABSTRACT

Provided is a heating device including a transparent endless pressurizing member that pressurizes a heating target, a contact member that transmits light which is emitted from a light source to heat the heating target, and comes in contact with an inner circumferential surface of the pressurizing member, a support member that supports the contact member within the pressurizing member, and a reflection section that is provided between the contact member and the support member, and reflects light toward a side opposite to the support member.

11 Claims, 11 Drawing Sheets

HEATING DEVICE, FIXING DEVICE, AND IMAGE FORMING APPARATUS

CROSS-REFERENCE TO RELATED APPLICATIONS

This application is based on and claims priority under 35 USC 119 from Japanese Patent Application No. 2014-152311 filed Jul. 25, 2014.

BACKGROUND

Technical Field

The present invention relates to a heating device, a fixing device, and an image forming apparatus.

SUMMARY

According to an aspect of the invention, there is provided a heating device including:

a transparent endless pressurizing member that pressurizes a heating target;

a contact member that transmits light which is emitted from a light source to heat the heating target, and comes in contact with an inner circumferential surface of the pressurizing member;

a support member that supports the contact member within the pressurizing member; and a reflection section that is provided between the contact member and the support member, and reflects light toward a side opposite to the support member.

BRIEF DESCRIPTION OF THE DRAWINGS

Exemplary embodiments of the present invention will be described in detail based on the following figures, wherein.

DETAILED DESCRIPTION

[First Exemplary Embodiment]

Examples of a heating device, a fixing device and an image forming apparatus according to a first exemplary embodiment will be described.

Entire Configuration

Figure 1:
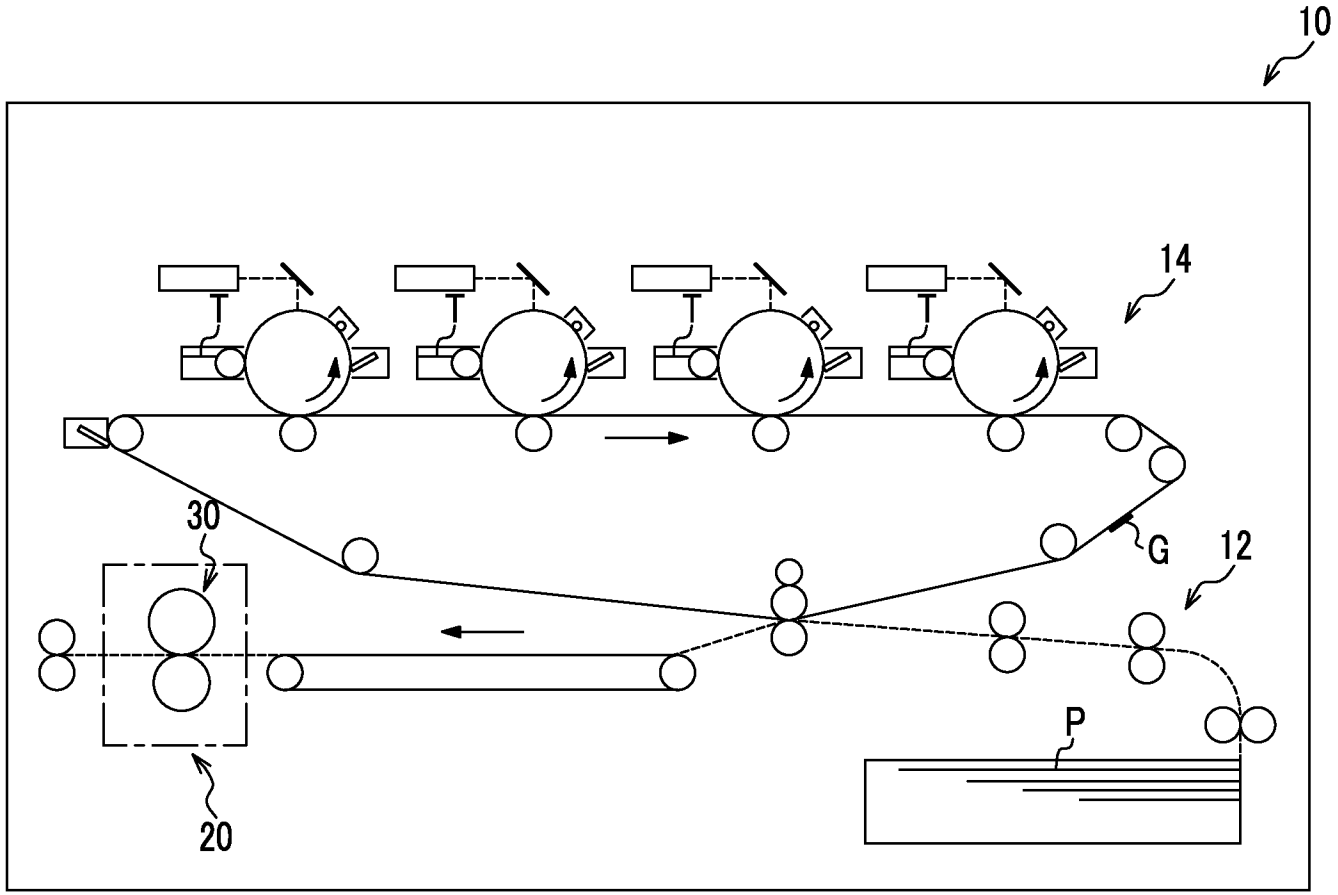
FIG. 1 is an entire configuration diagram that schematically shows an image forming apparatus according to a first exemplary embodiment.

FIG. 1 shows an image forming apparatus 10 according to the first exemplary embodiment. The image forming apparatus 10 includes, for example, a transport unit 12 that transports sheet P, an image forming unit 14 that forms a toner image G by using toner T on the transported sheet P, and a fixing device 20 that fixes the toner image G on the sheet P. The sheet P is an example of a recording medium. The toner T is an example of a developer and a heating target. The toner image G is an example of a developer image. The image forming unit 14 is an example of a developer image forming unit. The image forming unit 14 is configured to perform a charging process, an exposing process, a developing process, a transferring process and a cleaning process.

Configuration of Major Components

Next, the fixing device 20 will be described.

Figure 2:
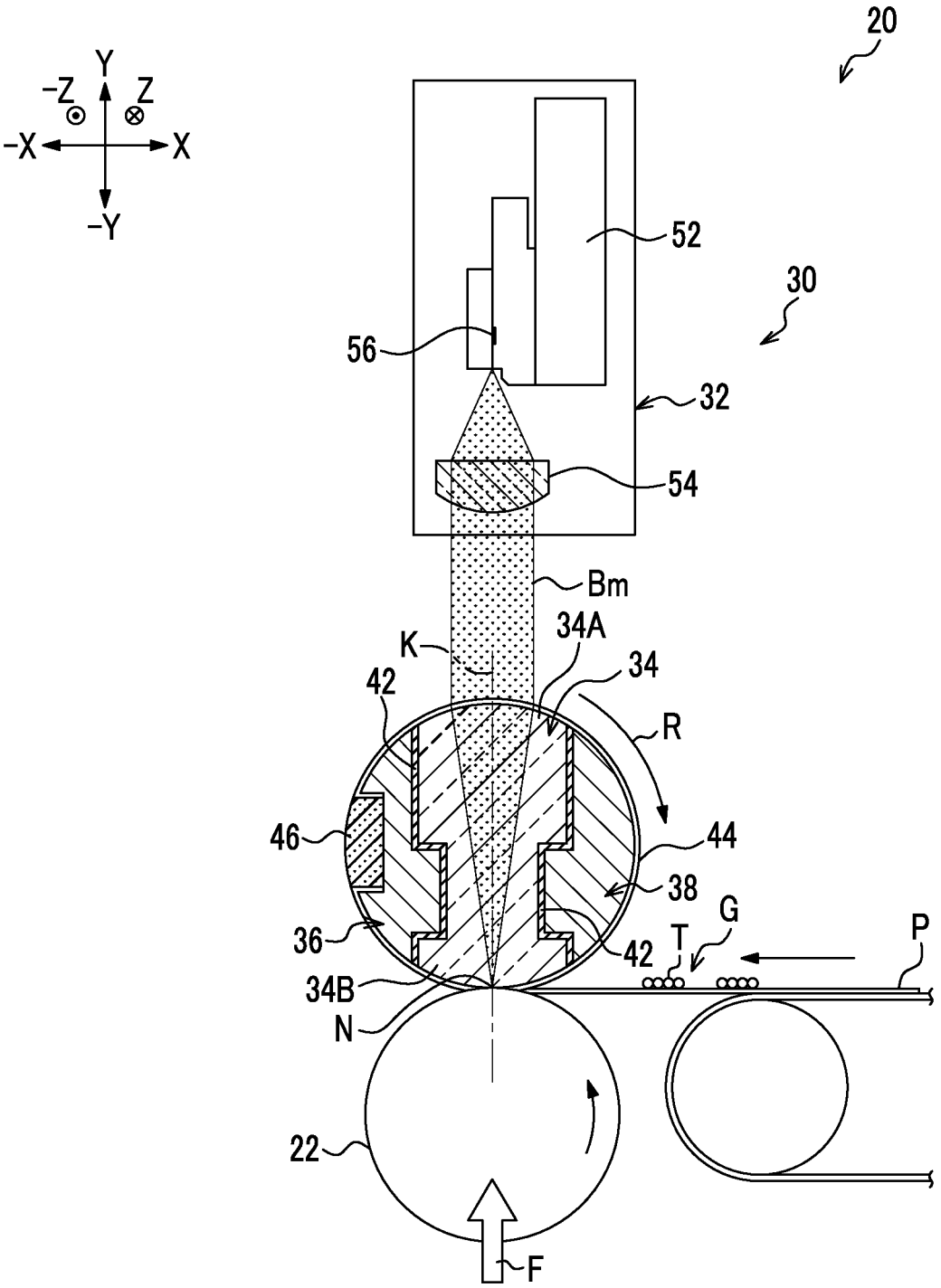
FIG. 2 is a schematic configuration diagram showing a fixing device according to the first exemplary embodiment.

As shown in FIG. 2, the fixing device 20 includes a facing roll 22 as an example of a transport unit that transports the sheet P to which the toner T adheres, and a heating unit 30 as an example of a heating device that irradiates the toner T on the sheet P with laser beams Bm as an example of light to heat the toner T.

Facing Roll

The facing roll 22 is, for example, a housing made from stainless steel, and is disposed such that a predetermined pressurizing force acts between the facing roll and a transparent tube 44, to be described below. The facing roll 22 is driven to be rotated by, for example, a non-illustration gear and motor, and is configured such that the sheet P interposed between the transparent tube 44 and the facing roll is transported.

Heating Unit

A pressurizing member used in the present exemplary embodiment has an endless shape and a rotatable shape. The endless shape includes a cylindrical shape and a hollow shape. As shown in FIG. 2, the heating unit 30 includes the transparent tube 44 as an example of the pressurizing member, a light irradiation unit 32 as an example of a light source, a lens pad 34 as an example of a contact member, and support frames 36 and 38 as examples of support members that support the lens pad 34. The heating unit 30 includes a reflection film 42 as an example of a reflection section, and a liquid coating unit that coats an inner circumferential surface of the transparent tube 44 with a transparent liquid.

Light Irradiation Unit

The light irradiation unit 32 includes a laser array 52, and a collimating lens 54. Plural laser light sources 56 are arranged in the laser array 52. The collimating lens 54 is an optical member that renders each laser beam Bm emitted from each laser light source 56 into parallel light.

Lens Pad

The lens pad 34 is an elongated lens member that extends in a longitudinal direction of the laser array 52. As the material of the lens pad 34, a heat-resistant material may be generally selected among materials used for a lens, and an optical transparent plastic resin may be used. As the optical transparent plastic resin, a material that contains poly(diethylene glycol bis(allyl carbonate)) (PADC), and polymethyl methacrylate (PMMA), polystyrene (PSt) is used. As the optical transparent plastic resin, a material that contains a polymer (MS resin) consisting of a methyl methacrylate unit and a styrene unit, polycarbonate resin, cycloolefin resin, and fluorene resin is used.

The lens pad 34 transmits the plural laser beams Bm from the laser array 52, and condenses the laser beams toward a transmission direction. The lens pad 34 is disposed such that an optical axis K is located in a center in a transport direction of the sheet P.

In the following description, for example, a longitudinal direction of the laser array 52 is described as a Z direction, a direction which is perpendicular to the Z direction and in which the laser beams Bm are applied is described as a Y direction, and a direction which is perpendicular to the Z direction and the Y direction and in which the sheet P is transported is described as an X direction. A rotation direction of the transparent tube 44 is described as an R direction. When it is necessary to distinguish one side of the X direction, the Y direction, or the Z direction from the other side thereof, in a front view along the longitudinal direction of the lens pad 34, an upper side is described as a Y side, a lower side is described as a −Y side, a right side is described as an X side, a left side is described as a −X side, a back side is described as a Z side, and a front side is described as a −Z side.

Figure 3:
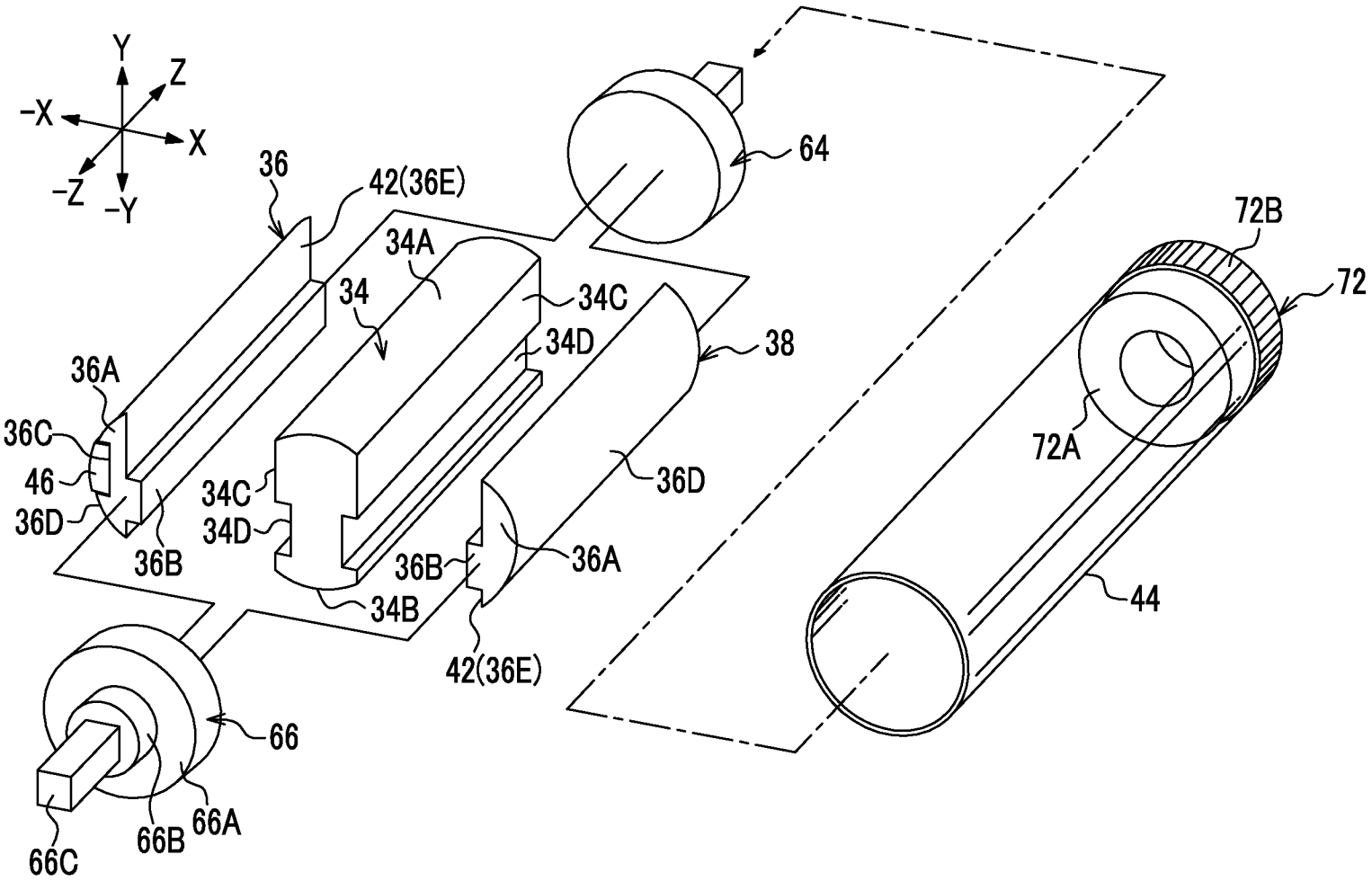
FIG. 3 is an exploded view of major components of the fixing device according to the first exemplary embodiment.

As shown in FIG. 3, the lens pad 34 includes a light incident surface 34A, and a light emission surface 34B. The light incident surface 34A is formed in a convex arc shape on the Y side when viewed in the Z direction, is disposed in a light incident region of the transparent tube 44, and comes in contact with the inner circumferential surface of the transparent tube 44.

The light emission surface 34B is formed in a convex arc shape on the −Y side when viewed in the Z direction, is disposed in a light emission region of the transparent tube 44, and comes in contact with the inner circumferential surface of the transparent tube 44. In the present exemplary embodiment, for example, it is assumed that a portion where the light emission surface 34B and the transparent tube 44 come in contact with each other is a contact portion N (see FIG. 2).

The lens pad 34 includes side surfaces 34C along a Z-Y surface between the light incident surface 34A and the light emission surface 34B. Positioning grooves 34D whose cross sections have a rectangular shape and are recessed from the side surfaces 34C by one step are integrally formed on parts of the side surfaces 34C. The lens pad 34 is supported and held within the transparent tube 44 through the support frames 36 and 38.

Support Frame

As shown in FIG. 3, the support frame 36 is, for example, an elongated member which is long in the Z direction, and includes a semi-circular guide portion 36A that protrudes toward the −X side when viewed in the Z direction, and a rectangular convex portion 36B that protrudes toward the X side from a portion of the −Y side rather than a center of the guide portion 36A in the Y direction. The support frame 36 is made from a material that absorbs the laser beams Bm (see FIG. 2), and is made from, for example, stainless steel.

The guide portion 36A includes a curved surface 36D disposed on the −X side when viewed in the Z direction, and a flat surface 36E disposed on the X side. The curved surface 36D has a radius corresponding to a radius of the inner circumferential surface of the transparent tube 44. A concave portion 36C that is opened to the −X side is formed in a portion of the curved surface 36D. The liquid coating unit 46 is received in the concave portion 36C.

The convex portion 36B has a size capable of being fitted into the positioning groove 34D on the −X side of the lens pad 34. By fitting the convex portion 36B into the positioning groove 34D, the lens pad 34 is positioned in the support frame 36. Although the detailed description will be described below, the reflection film 42 is formed on surfaces of the flat surface 36E and the convex portion 36B.

For example, the support frame 38 has the same configuration (material, shape, and size) as those of the support frame 36 except for the concave portion 36C. For this reason, some parts of the support frame 38 will be assigned the same reference numerals as those of the support frame 36, and the description thereof will not be described. The convex portion 36B of the support frame 38 has a size capable of being fitted into the positioning groove 34D on the X side of the lens pad 34. The reflection film 42 is formed on surfaces of the flat surface 36E and the convex portion 36B of the support frame 38.

Here, the lens pad 34, the support frame 36 and the support frame 38 have a cylindrical shape as a whole in an assembled state. Thus, the lens pad 34, the support frame 36 and the support frame 38 may be arranged inside the transparent tube 44. The support frame 36 and the support frame 38 support the lens pad 34 within the transparent tube 44.

Holding Member

As shown in FIG. 3, a holding member 64 is provided at ends of the support frame 36 and the support frame 38 on the Z side, and a holding member 66 is provided at ends of the support frame 36 and the support frame 38 on the −Z side. For example, since the holding member 64 and the holding member 66 have the same configuration, the holding member 66 will be described, and the holding member 64 will not be described.

The holding member 66 includes, for example, a cylindrical lid 66A with the Z direction as an axial direction, a stepped portion 66B that protrudes toward the −Z side from a center of the lid 66A and has a diameter smaller than the lid 66A, and a prismatic supporting shaft 66C that protrudes from the stepped portion 66B toward the −Z side. The supporting shaft 66C protrudes toward the Z side or the −Z side from an end cap 72 to be described below, and is supported by a non-illustration bracket.

Transparent Tube

In the present exemplary embodiment, the term "transparent" of the transparent tube 44 means that a transmittance is sufficiently high in a wavelength region of the laser beams Bm. That is, any transparent tube may be used as long as the transparent tube 44 transmits the laser beams Bm. In order to improve light utilization efficiency or in order to suppress heating of the lens pad 34, the higher a transmittance is, the better the transparent tube is. The transmittance may be, for example, 90[%] or more, and preferably, 95[%] or more.

The transparent tube 44 includes, for example, a base material layer for maintaining a required strength, an elastic layer laminated on the base material layer, and a releasing layer laminated on the elastic layer. The base material layer, the elastic layer and the releasing layer will not be shown. The transparent tube 44 is not limited to a three-layer structure.

Examples of a material of the base material layer include polyvinylidene fluoride (PVDF), polyimide (PI), polyethylene (PE), polyurethane (PU), and polydimethylsiloxane (PDMS). Examples of the material of the base material layer include polyetheretherketone (PEEK), polyethersulfone (PES), fluorinated ethylene propylene (FEP), and ethylene tetrafluoroethylene copolymer (ETFE). Examples of the material of the base material layer include chlorotrifluoroethylene (CTFE), polyvinylidene fluoride (PVDF), polyvinyl fluoride (PVF), and polytetrafluoroethylene (PTFE). The base material layer may be made from a material selected from a group consisting of mixtures of the aforementioned materials.

The elastic layer is made from LSR silicone rubber, HTV silicone rubber or RTV silicone rubber, and any elastic layer may be used as long as the elastic layer transmits the laser beams Bm and has elasticity that absorbs unevenness of the sheet P or a difference in grade of the toner image G.

The releasing layer is made from fluororesin, for example, tetrafluoroethylene copolymer (PTFE), tetrafluoroethylene-perfluoroalkoxy ethylene copolymer (PFA), or tetrafluoroethylene-hexafluoropropylene copolymer (FEP). Any releasing layer may be used as long as the releasing layer transmits the laser beams Bm and prompts the transparent tube 44 to be released from the toner image G formed on the sheet P. The releasing layer has a function of providing a desirable glossiness to the fixed image (toner image G) by cooperating with the elastic layer.

End Cap

The end caps 72 are respectively provided on the Z side and the −Z side of the transparent tube 44. The end cap 72 on the −Z side is not shown in FIG. 3.

Each of the end caps 72 includes a cylindrical portion 72A that is fitted into the inner circumferential surface of the transparent tube 44 on the Z side or the inner circumferential surface on the −Z side, and a gear 72B that is integrally provided on one side of the cylindrical portion 72A in the Z direction. The stepped portion 66B is inserted into the cylindrical portion 72A. While the stepped portion 66B is inserted into the cylindrical portion 72A, the end caps 72 and the transparent tube 44 are relatively moved (are rotatably moved) with respect to the holding members 64 and 66. The gear 72B is driven to be rotated by a non-illustration motor, and supplies rotation driving force to the transparent tube 44.

As described above, for example, the facing roll 22 and the transparent tube 44 shown in FIG. 2 respectively include independent driving sources, but a non-illustration one-way clutch is provided at any one of the facing roll and the transparent tube.

Liquid Coating Unit

As shown in FIG. 2, the liquid coating unit 46 is made from, for example, a felt material, and comes in contact with the inner circumferential surface of the transparent tube 44. Silicone oil as an example of a transparent liquid is infiltrated into the liquid coating unit 46. Thus, the inner circumferential surface of the transparent tube 44 is coated with the silicone oil by rotating the transparent tube 44.

Reflection Film

Next, the reflection films 42 will be described.

Figure 4A:
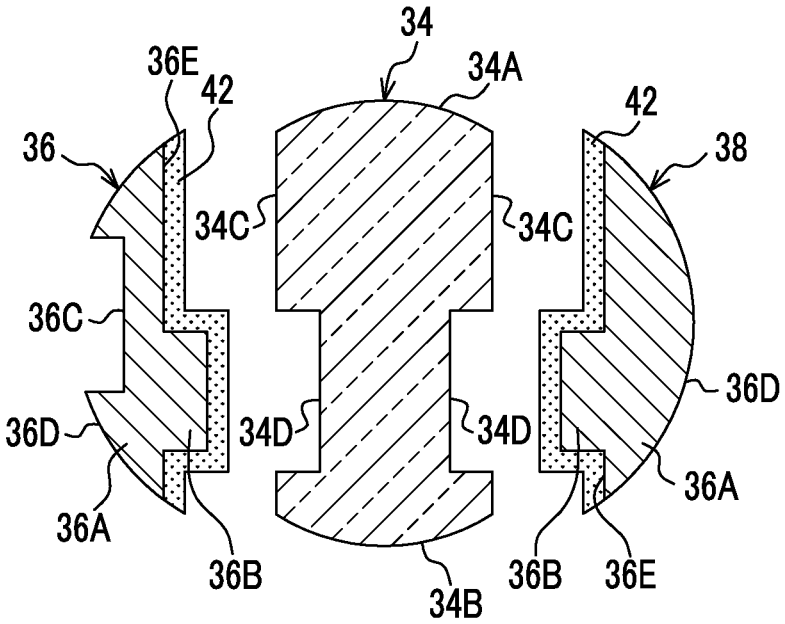
FIG. 4A is a longitudinal cross-sectional view showing an exploded state of the major components of the fixing device according to the first exemplary embodiment.

The reflection films 42 shown in FIG. 4A are made from, for example, white paint containing fine particles of titanium oxide. Surfaces of the convex portions 36B and surfaces of the flat surfaces 36E of the support frames 36 and 38 are coated with the reflection films 42. The material of the reflection film 42 is not limited to the titanium oxide, and may be selected from materials having characteristics that reflect the laser beams Bm of the light irradiation unit 32 (see FIG. 2).

Figure 4B:
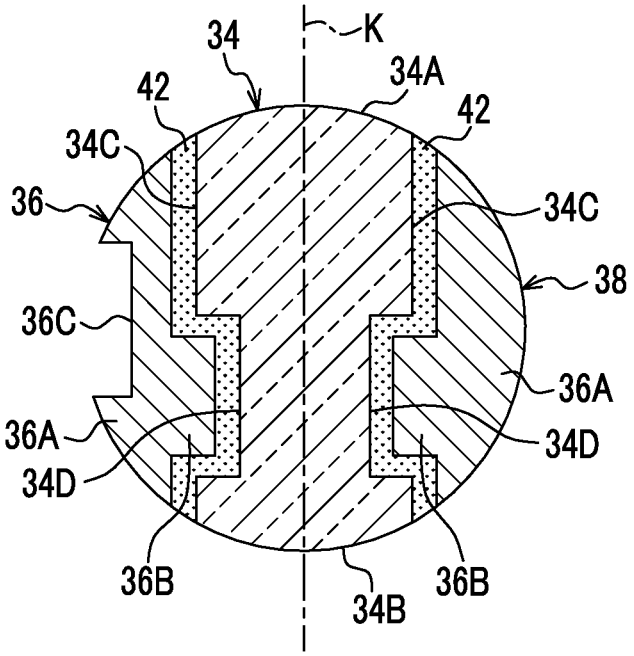
FIG. 4B is a longitudinal cross-sectional view showing an assembled state of the major components of the fixing device according to the first exemplary embodiment.

As shown in FIG. 4B, the convex portions 36B of the support frames 36 and 38 are fitted into the positioning grooves 34D of the lens pad 34. Thus, the reflection films 42 are formed between the optical axis K and the support frames 36 and 38. In other words, the reflection films 42 are formed on the surfaces of the support frames 36 and 38 close to the lens pad (that is, a side close to the optical axis K).

Figure 5:
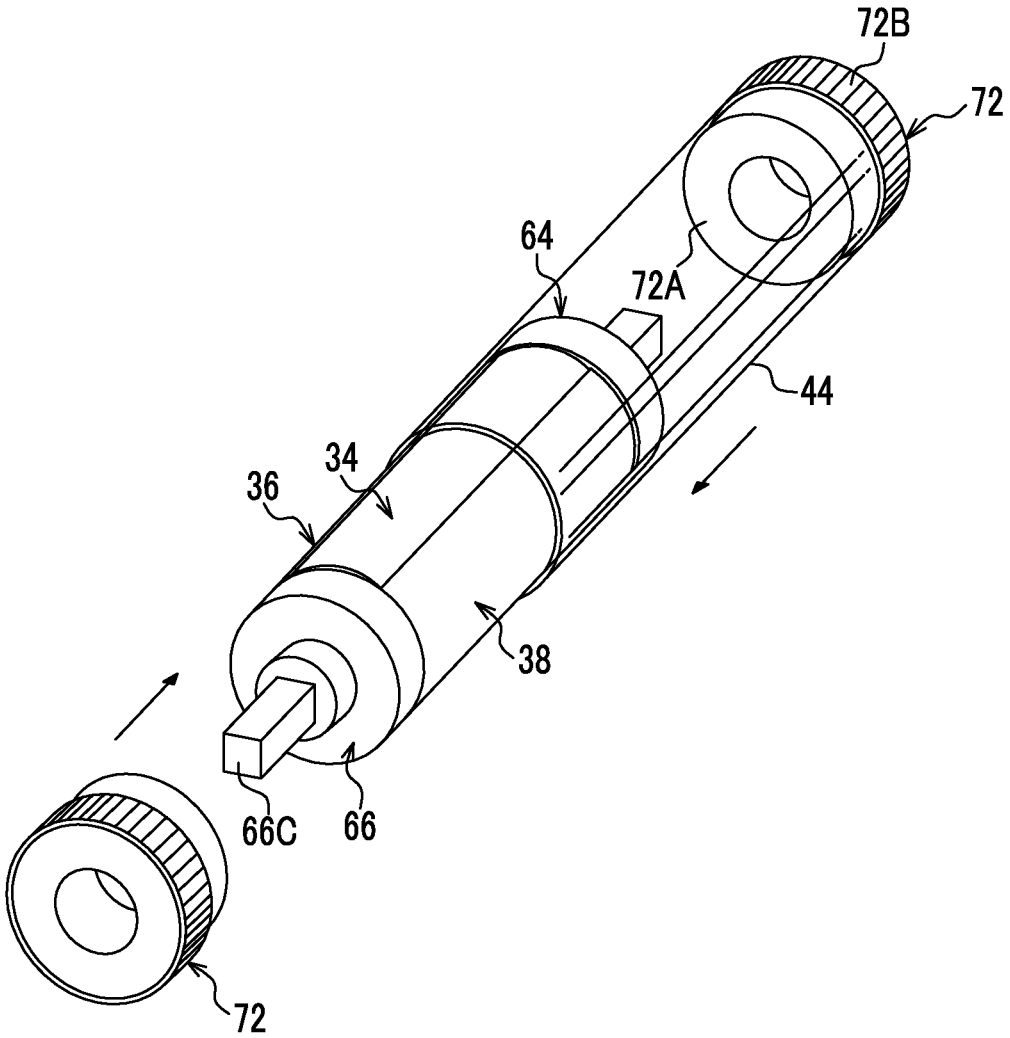
FIG. 5 is an explanatory diagram showing the assembled state of the major components of the fixing device according to the first exemplary embodiment.

As shown in FIGS. 3 and 5, after the lens pad 34 is held by the support frames 36 and 38, the lens pad 34 on the Z side and the −Z side is held by the holding members 64 and 66. The liquid coating unit 46 (see FIG. 3) is attached to the concave portion 36C. Subsequently, these members are inserted into the transparent tube 44, and the end caps 72 are respectively attached to both ends of the holding members 64 and 66 and the transparent tube 44. Thereafter, the transparent tube is supported by the non-illustration bracket, and, thus, the transparent tube 44 may be rotatably supported.

Operation

Next, an operation of the first exemplary embodiment will be described.

As shown in FIG. 2, in the heating unit 30, the laser beams Bm emitted from the light irradiation unit 32 are transmitted through the transparent tube 44, and are incident on the light incident surface 34A of the lens pad 34. The laser beams Bm incident on the light incident surface 34A are condensed in the lens pad 34, are transmitted through the light emission surface 34B and the transparent tube 44, and are applied to the toner T on the sheet P during the transporting. The toner T (toner image G) on the sheet P is heated and melted by absorbing the condensed laser beams Bm, and is fixed on the sheet P by receiving pressurizing force F from the facing roll 22.

Figure 6:
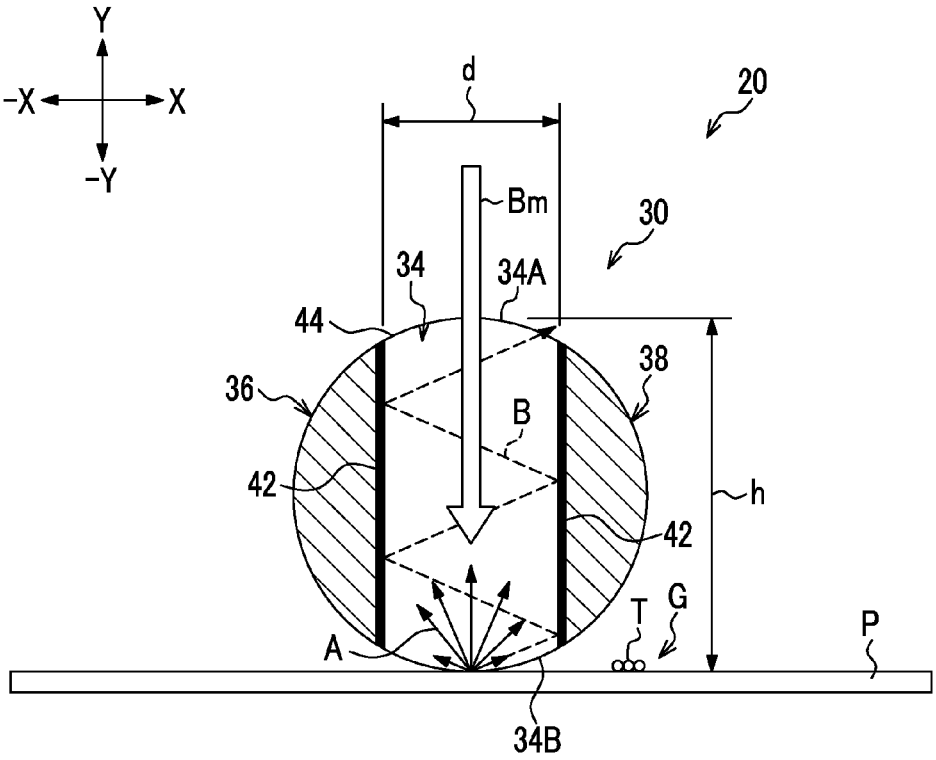
FIG. 6 is an explanatory diagram that schematically shows a state where laser beams are incident, scattered and reflected in the fixing device according to the first exemplary embodiment.

As shown in FIG. 6, among the laser beams Bm incident on the lens pad 34, laser beams which are not absorbed by the toner T are scattered on the sheet P to become scattered light beams A (indicated by arrow A). Among the scattered light beams A, some scattered light beams travel toward the support frames 36 and 38. Here, since the reflection films 42 are formed on the support frames 36 and 38, the scattered light beams A traveling toward the support frames 36 and 38 are reflected toward opposite sides to the support frames 36 and 38 by the reflection films 42 to become reflected light beams B (indicated by arrow B). The reflected light beams travel in the lens pad 34. Thus, since the scattered light beams A are prevented from being absorbed by the support frames 36 and 38, temperatures of the support frames 36 and 38 are prevented from increasing. The convex portions 36B of the support frames 36 and 38 (see FIG. 4A) are not shown in FIG. 6.

Figure 7:
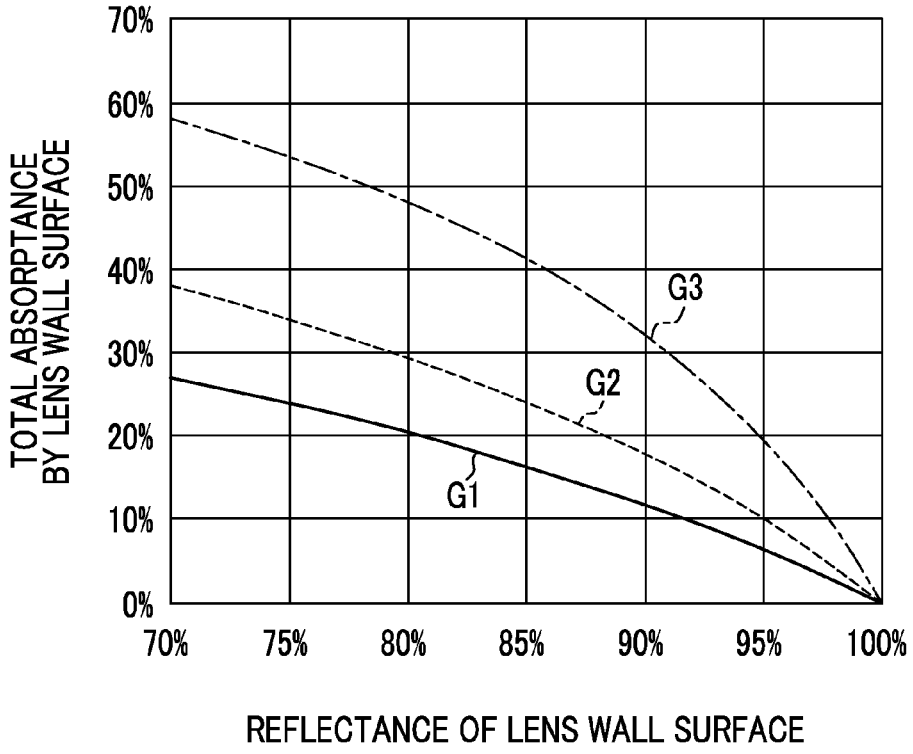
FIG. 7 is a graph representing a total absorptance by a lens wall surface and a reflectance of the lens wall surface according to the first exemplary embodiment.

FIG. 7 shows graphs G1, G2 and G3 that represent a relationship between a reflectance of a lens wall surface and a total absorptance by the lens wall surface. The reflectance of the lens wall surface refers to a ratio of an amount of the laser beams Bm reflected from the reflection films 42 to an amount of the laser beams Bm incident on the reflection films 42 (see FIG. 2). A unit of the reflectance of the lens wall surface is denoted by %. The reflectance of the lens wall surface refers to a reflectance of single reflection in the reflection film 42.

The total absorptance by the lens wall surface is a ratio of an amount of the laser beams Bm absorbed by the support frames 36 and 38 to a total amount of the laser beams Bm incident on the lens pad 34. A unit of the total absorptance by the lens wall surface is denoted by %.

It is assumed that an opening width of the light incident surface 34A of the lens pad 34 shown in FIG. 6 in the X direction is d. The opening width d is a space between the reflection films 42 facing each other in the X direction. It is assumed that a height of the lens pad 34 in the Y direction is h. Here, in FIG. 7, the graph G1 represents a result when d=15 [mm] and h=30 [mm], the graph G2 represents a result when d=10 [mm] and h=30 [mm], and the graph G3 represents a result when d=5 [mm] and h=30 [mm].

As may be seen from the graphs G1, G2 and G3 shown in FIG. 7, when the reflectance of the lens wall surface is increased, the total absorptance by the lens wall surface is decreased. Even with the same reflectance of the lens wall surface, as the opening width d (see FIG. 6) becomes wide, the total absorptance by the lens wall surface is decreased. This is because as the opening width d becomes wide, the number of times the laser beams Bm (see FIG. 6) are incident on the lens wall surface decreases.

Here, for example, in the graph G2, when the reflectance of the lens wall surface is 70[%], the total absorptance by the lens wall surface is approximately 40[%]. When the reflectance of the lens wall surface is 95[%], the total absorptance by the lens wall surface is approximately 10[%]. That is, when the reflectance of the reflection film 42 (see FIG. 2) is set to 95[%], an absorbing amount of the scattered light beams A (see FIG. 6) is approximately a quarter of that in the case where the reflectance is 70[%]. Since a difference between the absorbing amounts becomes a difference between temperature rises of the support frames 36 and 38 (see FIG. 2), when the reflection film 42 having a reflectance of 95[%] is used, the temperature rises of the support frames 36 and 38 are suppressed compared to the case where the reflection film 42 having a reflectance of 70[%] is used.

As shown in FIG. 4A, in the heating unit 30, the reflection films 42 are formed on the support frames 36 and 38 through coating, and are integrally formed with the support frames 36 and 38. For this reason, positions of the reflection film 42 are prevented from being deviated from the support frames 36 and 38 compared to the case where the reflection films 42 and the support frames 36 and 38 are separately provided. Since the positions of the reflection film 42 are prevented from being deviated, the scattered light beams A (see FIG. 6) are prevented from being incident on the support frames 36 and 38, and the temperature rises of the support frames 36 and 38 are suppressed.

In the fixing device 20 shown in FIG. 2, since the laser beams Bm are reflected from the reflection film 42, the temperature rises of the support frames 36 and 38 are suppressed. For this reason, the support frames 36 and 38 are prevented from heating the transparent tube 44 and the sheet P to more than a set temperature, and the toner T is prevented from being heated (overheated) to more than the set temperature. Thus, since adhesion force of the sheet P and the toner T to the transparent tube 44 is prevented from increasing, fixing failure of the toner image G on the sheet P caused by the overheating of the toner T by the transparent tube 44 is suppressed.

In the image forming apparatus 10 shown in FIG. 1, since the fixing failure of the toner image G in the fixing device 20 is suppressed, an image defect caused by the fixing failure is suppressed.

[Second Exemplary Embodiment]

Next, examples of a heating device, a fixing device and an image forming apparatus according to a second exemplary embodiment will be described. Components and portions that are basically the same as those in the first exemplary embodiment are assigned the same reference numerals as those in the first exemplary embodiment, and the description thereof will not be described.

Figure 8A:
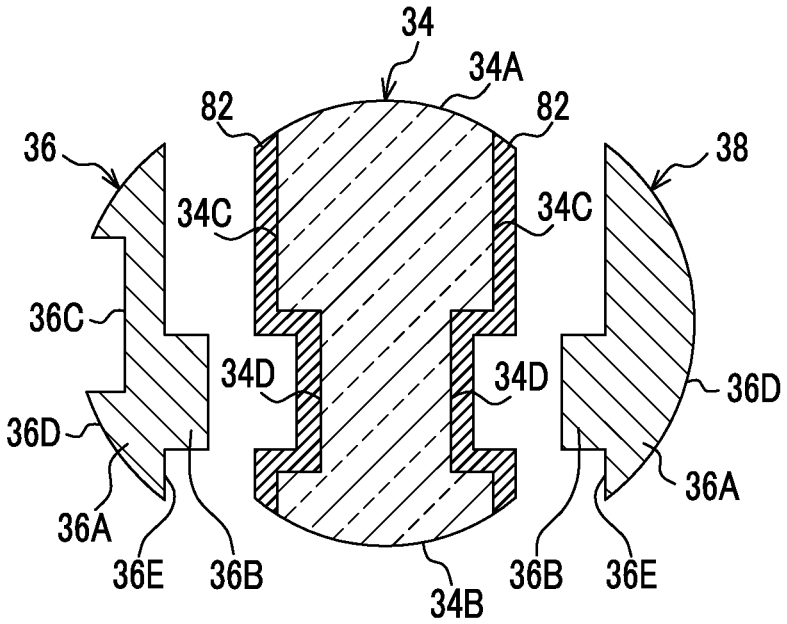
FIG. 8A is a longitudinal cross-sectional view showing an exploded state of major components of a fixing device according to a second exemplary embodiment.

FIG. 8A shows reflection films 82 according to the second exemplary embodiment. The second exemplary embodiment has a difference from the first exemplary embodiment in that the reflection films 82 are formed instead of the reflection films 42 (see FIG. 2) in the image forming apparatus 10, the fixing device 20 and the heating unit 30 according to the first exemplary embodiment (see FIG. 1), and other configurations are the same as those in the first exemplary embodiment.

The reflection films 82 shown in FIG. 8A are made from, for example, aluminum. The reflection films 82 are deposited on the surfaces of the side surfaces 34C of the lens pad 34 and the surfaces of the positioning grooves 34D by using a known metal deposition method. The material of the reflection film is not limited to aluminum, and may be selected from materials having characteristics that reflect the laser beams Bm (see FIG. 2) of the light irradiation unit 32 (see FIG. 2). The surface of the deposited reflection film 82 approaches a mirror surface state.

Figure 8B:
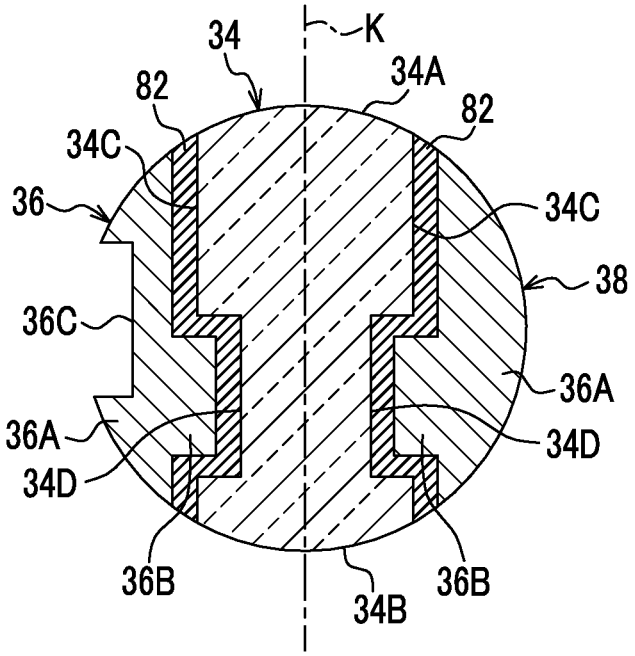
FIG. 8B is a longitudinal cross-sectional view showing an assembled state of the major components of the fixing device according to the second exemplary embodiment.

As shown in FIG. 8B, the convex portions 36B of the support frames 36 and 38 are fitted into the positioning grooves 34D of the lens pad 34. Thus, the reflection films 82 are formed between the support frames 36 and 38 and the lens pad 34. In other words, the reflection films 82 are formed on the surfaces of the lens pad 34 close to the support frames 36 and 38.

Operation

Next, an operation of the second exemplary embodiment will be described.

Figure 9:
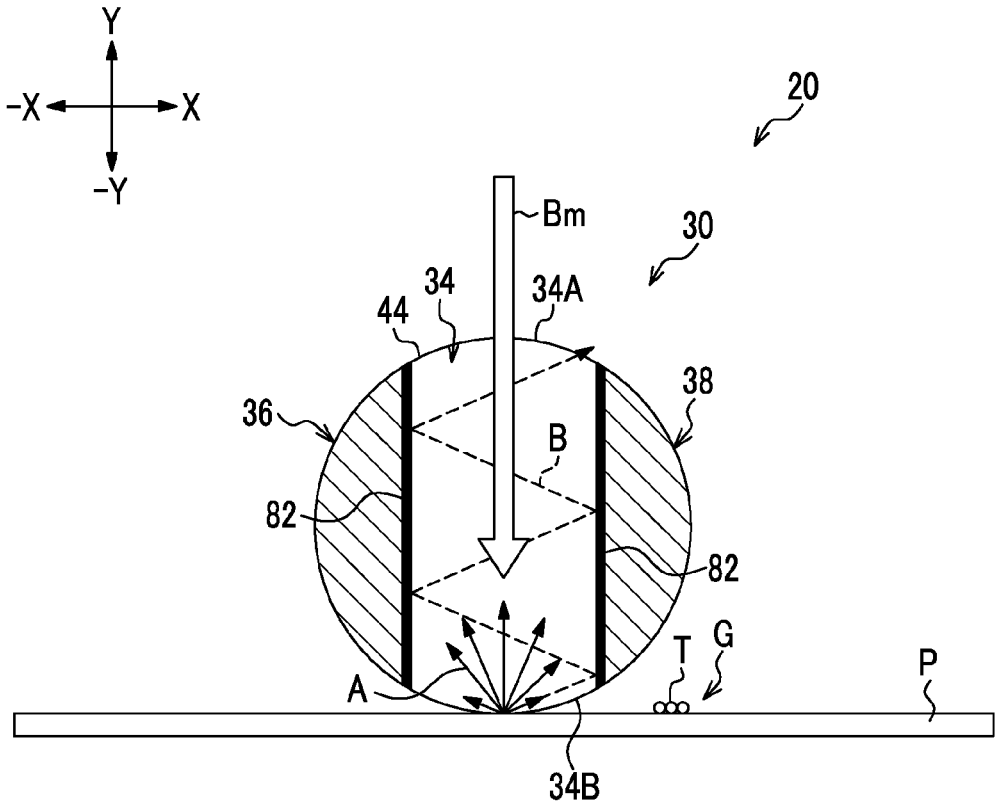
FIG. 9 is an explanatory diagram that schematically shows a state where laser beams are incident, scattered and reflected in the fixing device according to the second exemplary embodiment.

As shown in FIG. 9, some scattered light beams A travel toward the support frames 36 and 38. Here, since the reflection films 82 are formed on the support frames 36 and 38, the scattered light beams A traveling toward the support frames 36 and 38 are reflected toward opposite sides to the support frames 36 and 38 by the reflection films 82 to become reflected light beams B. The reflected light beams travel in the lens pad 34. Thus, since the support frames 36 and 38 are prevented from absorbing the scattered light beams A to be overheated, the temperature rises of the support frames 36 and 38 are suppressed. The convex portions 36B of the support frames 36 and 38 (see FIG. 8A) are not shown in FIG. 9.

As shown in FIG. 8A, in the heating unit 30, the reflection films 82 are formed by being deposited on the lens pad 34, and are integrated with the lens pad 34. For this reason, compared to the case where the reflection film 82 and the support frames 36 and 38 are separately provided, the positions of the reflection film 82 are prevented from being deviated from the support frames 36 and 38. Thus, the scattered light beams A (see FIG. 9) are prevented from being incident on the support frames 36 and 38, and the temperature rises of the support frames 36 and 38 are suppressed.

[Third Exemplary Embodiment]

Next, examples of a heating device, a fixing device and an image forming apparatus according to a third exemplary embodiment will be described. Components and portions that are basically the same as those in the first exemplary embodiment are assigned the same reference numerals as those in the first exemplary embodiment, and the description thereof will not be described.

Figure 10:
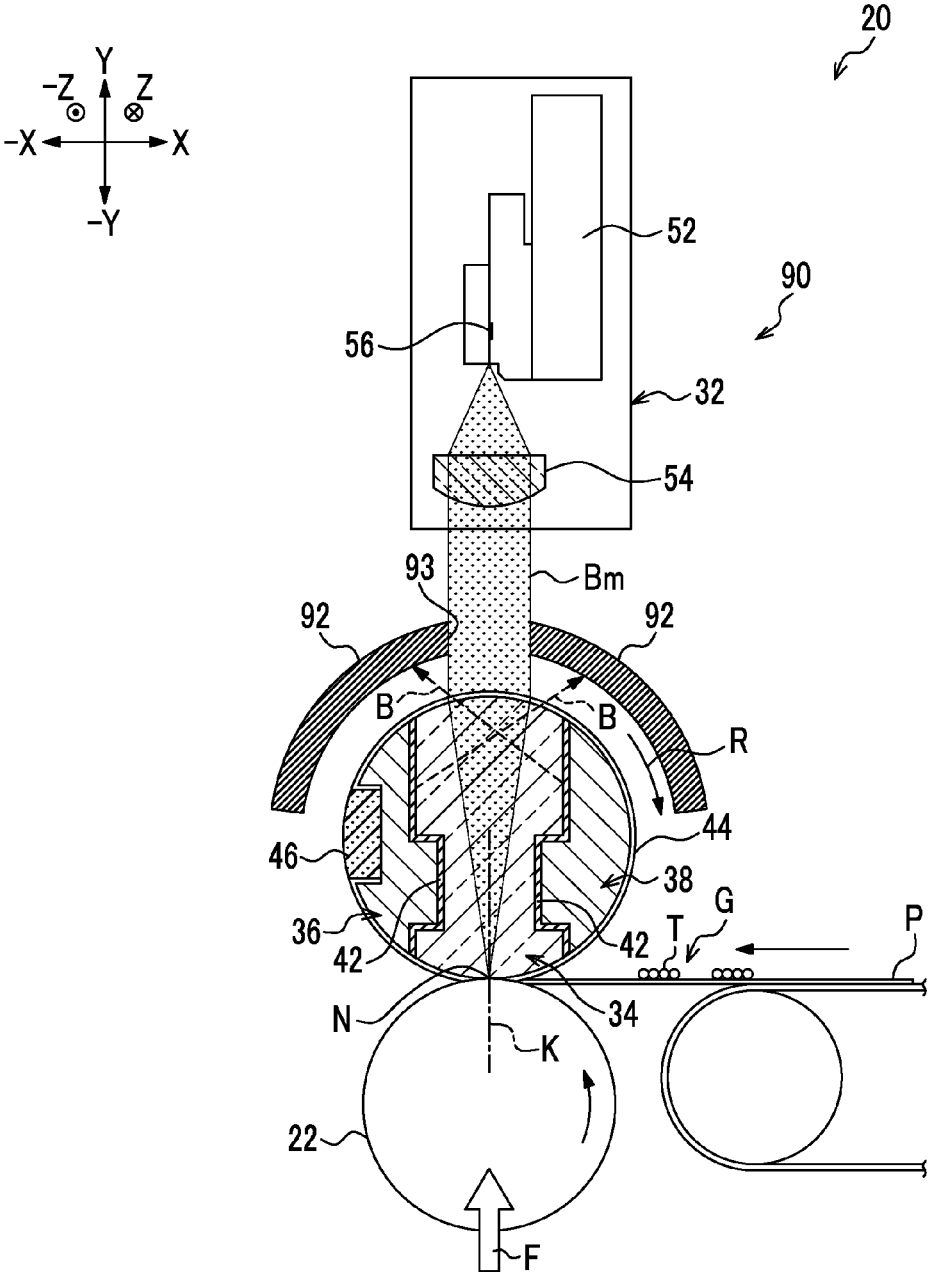
FIG. 10 is a schematic configuration diagram showing a fixing device according to a third exemplary embodiment.

FIG. 10 shows a heating unit 90 as an example of the heating device according to the third exemplary embodiment. The third exemplary embodiment is different from the first exemplary embodiment in that the heating unit 90 is provided instead of the heating unit 30 in the image forming apparatus 10, the fixing device 20 and the heating unit 30 (see FIG. 1), and other configurations are the same as those in the first exemplary embodiment. The heating unit 90 has a difference from the heating unit 30 according to the first exemplary embodiment in that a cover member 92 as an example of an absorbing member is added, and other configurations are the same as those in the first exemplary embodiment.

The cover member 92 is, for example, a member with the Z direction as a longitudinal direction and the X direction as a lateral direction, and an X-Y cross section thereof has a semi-circular shape. A through hole 93 through which the laser beams Bm pass is formed in the cover member 92. The through hole 93 is a hole that has a width in the X direction greater than a beam diameter of the laser beams Bm and extends in the Z direction. The cover member 92 is made from, for example, aluminum, and a black alumite process is performed on a surface of the cover member disposed to face the transparent tube 44. The process on the surface disposed to face the transparent tube 44 of the cover member 92 is not limited to the black alumite process, and may be selected from processes using materials having characteristics that absorb the laser beams Bm.

The cover member 92 has a convex shape on the Y side, faces the transparent tube 44 in a diametrical direction of the transparent tube 44, and is disposed between the light irradiation unit 32 and the transparent tube 44 such that the through hole 93 does not block traveling of the laser beams Bm. The cover member 92 covers the transparent tube 44 when viewed in the Y direction.

Operation

Next, an operation of the third exemplary embodiment will be described.

In the heating unit 90 shown in FIG. 10, among the laser beams Bm incident on the lens pad 34, scattered light beams (not shown) scattered from the sheet P travel toward the support frames 36 and 38, and are reflected from the reflection films 42 to become reflected light beams B. The reflected light beams travel in the lens pad 34. The reflected light beams B travel from an opening end (the Y side in the drawing) of the lens pad 34 toward the outside.

Here, since the cover member 92 is provided in a traveling direction of the reflected light beams B, the reflected light beams B are absorbed by the cover member 92. Thus, the light beams reflected from the sheet P are prevented from being incident on a member other than the cover member 92 within the fixing device 20 (heating unit 90). Since the reflected light beams B are prevented from being incident on the member other than the cover member 92 within the fixing device 20 and being reflected toward the support frames 36 and 38 again, the toner T is prevented from being overheated by the reflected light beams B traveling toward the outside of the lens pad 34.

The present invention is not limited to the aforementioned exemplary embodiments.

MODIFICATION EXAMPLE

Figure 11:
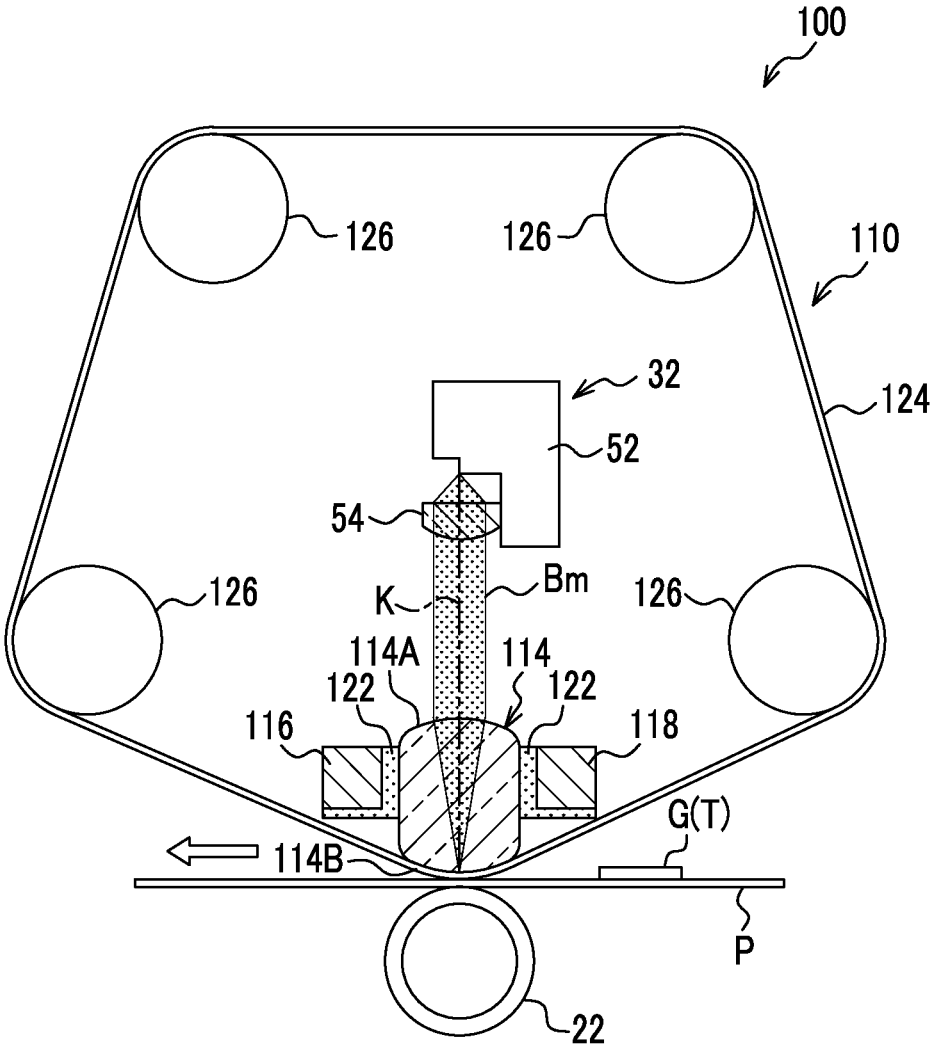
FIG. 11 is a schematic configuration diagram showing a fixing device according to a modification example.

As in the fixing device 20 shown in FIG. 2, the fixing device is not limited to the device using the transparent tube 44, but may be a fixing device 100 having a heating unit 110 as an example of the heating device as shown in FIG. 11. The fixing device 100 includes the heating unit 110, and the facing roll 22.

The heating unit 110 includes the light irradiation unit 32, a lens pad 114 as an example of the contact member, support frames 116 and 118 as examples of the support members that support the lens pad 114, and reflection films 122 as an example of the reflection section. The heating unit 110 includes a fixing belt 124 as an example of the pressurizing member.

The fixing belt 124 is made from a material that transmits the laser beams Bm, and is held by plural support rolls 126 to be circulated. The light irradiation unit 32 is disposed inside the fixing belt 124.

The lens pad 114 transmits the laser beams Bm and condenses the laser beams toward the transmission direction. The lens pad 114 includes a light incident surface 114A on which the laser beams Bm are incident, and a light emission surface 114B from which the laser beams Bm are emitted. The light emission surface 114B comes in contact with an inner circumferential surface of the fixing belt 124. The lens pad 114 is supported by the support frames 116 and 118.

The reflection films 122 are made from, for example, white paint containing fine particles of titanium oxide, and are formed on surfaces of the support frames 116 and 118 close to the lens pad 114 through coating. Lower surfaces of the support frames 116 and 118 are also coated with the reflection films 122. The lower surfaces of the support frames 116 and 118 are surfaces facing the fixing belt 124.

Here, in the fixing device 100 and the heating unit 110, since the laser beams Bm are reflected from the reflection films 122, the temperature rises of the support frames 116 and 118 are suppressed. Thus, since the support frames 116 and 118 are prevented from overheating the fixing belt 124, adhesion force of the sheet P to the fixing belt 124 is prevented from increasing, and the fixing failure of the toner image G on the sheet P caused by the overheating of the toner T by the fixing belt 124 is suppressed.

ANOTHER MODIFICATION EXAMPLE

The heating unit 30 or 110 is not limited to the fixing device 20 or 100 that fixes the toner T on the sheet P. For example, the heating unit 30 or 110 may preliminarily heat a liquid developer adhering to the sheet P by a liquid developing method before the fixing. The heating unit 30 or 110 may be used as a drying device for removing moisture in the sheet P.

The support frames 36 and 38 or the support frames 116 and 118 are not limited to the pair of two support frames. One support frame or plural (for example, three or more) support frames may be used. The support frames 36 and 38 or the support frames 116 and 118 may have a shape different from that in the aforementioned exemplary embodiments as long as the support frames have surfaces coming in contact with the lens pad 34 or 114.

The lens pad 34 or 114 is not limited to one lens pad, and plural lenses arranged at a space in an optical axial direction may be used.

As mentioned above, the material of the reflection film is not limited to aluminum or white paint containing titanium oxide as long as the reflection films 42, 82 or 122 reflect the laser beams Bm. For example, the reflection film may be made from gold. The reflection section is not limited to the reflection films 42, 82 or 122 formed on the surfaces of the members, and a member that is independently disposed from the contact member and the support members may be used such as a reflection plate.

The cover member 92 may be provided on the heating unit 30 according to the second exemplary embodiment or the heating unit 110 according to the modification examples in addition to the heating unit 30 according to the first exemplary embodiment.

The facing roll 22 may be made from aluminum or another metal as well as from stainless steel.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A heating device comprising:

a transparent endless pressurizing member that pressurizes a heating target;

a contact member that transmits light which is emitted from a light source to heat the heating target, and comes in contact with an inner circumferential surface of the pressurizing member;

a support member that supports the contact member within the pressurizing member; and a reflection section that is provided between the contact member and the support member, and reflects light toward a side opposite to the support member, wherein the reflecting section comes in contact with the contact member.

2. The heating device according to claim 1, wherein the reflection section is a reflection film formed on a surface of the support member close to the contact member.

3. The heating device according to claim 2, wherein an absorbing member that absorbs light is provided in a traveling direction of light reflected from the reflection section or the heating target.

4. The heating device according to claim 1, wherein an absorbing member that absorbs light is provided in a traveling direction of light reflected from the reflection section or the heating target.

5. A fixing device comprising:

a transport unit that transports a recording medium to which a developer as a heating target adheres; and the heating device according to claim 1 that irradiates the developer of the recording medium transported by the transport unit with light to heat the developer, and fixes the developer on the recording medium.

6. An image forming apparatus comprising:

a developer image forming unit that forms a developer image on a recording medium; and the fixing device according to claim 5 that fixes the developer image on the recording medium.

7. The fixing device according to claim 5, wherein the contact member is configured with one lens pad or a plurality of lenses.

8. The image forming apparatus according to claim 6, wherein the contact member is configured with one lens pad or a plurality of lenses.

9. The heating device according to claim 1, wherein the contact member is configured with one lens pad or a plurality of lenses.

10. A heating device comprising:

a transparent endless pressurizing member that pressurizes a heating target;

a contact member that transmits light which is emitted from a light source to heat the heating target, and comes in contact with an inner circumferential surface of the pressurizing member;

a support member that supports the contact member within the pressurizing member; and a reflection section that is provided between the contact member and the support member, and reflects light toward a side opposite to the support member, wherein the reflection section is a reflection film formed on a surface of the contact member close to the support member.

11. The heating device according to claim 10, wherein an absorbing member that absorbs light is provided in a traveling direction of light reflected from the reflection section or the heating target.

* * * * *